US006404136B1

(12) United States Patent
Murray et al.

(10) Patent No.: US 6,404,136 B1
(45) Date of Patent: Jun. 11, 2002

(54) METHOD AND CIRCUIT FOR CONTROLLING AN EMISSION CURRENT

(75) Inventors: David Murray, Chandler, AZ (US); Ken Foo, Gurnee, IL (US); Kim A. Hasler, Chandler, AZ (US)

(73) Assignee: Motorola Inc., Schaumburg, IL (US)

( * ) Notice: Subject to any disclaimer, the term of this patent is extended or adjusted under 35 U.S.C. 154(b) by 20 days.

(21) Appl. No.: 09/610,298

(22) Filed: Jul. 5, 2000

(51) Int. Cl.[7] ..... G09G 3/10; G05F 1/00

(52) U.S. Cl. ..... 315/169.1; 315/169.3

(58) Field of Search ..... 315/169.1, 291, 315/74, 307, 297, 169.2, 167, 349, 366, 169.4, 169.3; 313/308, 336

(56) References Cited

U.S. PATENT DOCUMENTS 5,514,937 A 5/1996 Kane et al. ..... 315/169.1
5,543,691 A * 8/1996 Palevsky et al. ..... 315/366
5,936,354 A * 8/1999 Smith et al. ..... 315/169.3
5,952,987 A * 9/1999 Browning et al. ..... 315/74
6,034,479 A * 3/2000 Xia ..... 315/169.1
6,060,840 A 5/2000 Foo et al. ..... 315/169.1
6,307,327 B1 * 10/2001 Xie et al. ..... 315/169.4

* cited by examiner

*Primary Examiner*—Don Wong
*Assistant Examiner*—Chuc Trand
(74) *Attorney, Agent, or Firm*—Kevin D. Wills

(57) ABSTRACT

A method for controlling an emission current (134) in a field emission display (100) includes measuring an emission current (134), measuring a portion of the plurality of pixels receiving emission current (134) as a percentage of the plurality of pixels on the anode (138) to define a set point, comparing measured value to set point value and adjusting gate voltage to cause emission current to approach set point value. A field emission display (100) includes a control circuit (111), which has an analog-to-digital converter (150), a current controller (154), as display timing controller (151) and a gate voltage source (158). Analog-to-digital converter (150) is designed to be connected to power supply (146). Gate voltage source (158) is connected to gate extraction electrode (126) and applies thereto the offset voltage, which is manipulated by current controller (154) in response to an output signal (152) of analog-to-digital converter (150) and an output signal of display timing controller (151).

14 Claims, 5 Drawing Sheets

100

METHOD AND CIRCUIT FOR CONTROLLING AN EMISSION CURRENT

FIELD OF THE INVENTION

The present invention relates, in general, to methods for controlling field emission displays, and, more particularly, to methods and circuits for maintaining constant emission current in field emission displays.

BACKGROUND OF THE INVENTION

Field emission displays are well known in the art. A field emission display includes an anode plate and a cathode plate that define a thin envelope. The cathode plate includes column electrodes and gate extraction electrodes, which are used to cause electron emission from electron emitter structures, such as Spindt tips.

During the operating life of a field emission display, the emissive surfaces of the electron emitter structures can be altered, such as by chemically reacting with contaminants that are evolved from surfaces within the display envelope. The contaminated emissive surfaces typically have electron emission properties that are inferior to those of the initial, uncontaminated emissive surfaces. In particular, contamination causes the electron emission current to decrease for a given set of operating parameters.

It is known in the art to provide a uniform and constant electron emission current by coupling a current source to each of the electron emitter structures. The current source is controlled to provide the desired emission current. However, this scheme can result in a complicated device that is difficult to fabricate and difficult to control.

Accordingly, there exists a need for a method and means for controlling the emission current in a field emission display, which is simple fabricate, easy to control, and extends the operational lifetime of the display.

BRIEF DESCRIPTION OF THE DRAWINGS

Referring to the drawing.

DESCRIPTION OF THE PREFERRED EMBODIMENTS

The invention is for a method and a field emission display useful for maintaining a constant emission current over the operating lifetime of the display. The method of the invention includes the steps of measuring an emission current, comparing the measured value to a set point value, and, if the values are not equal, manipulating a gate voltage to cause the emission current to approach the set point value. The set point value is determined based on the percentage of the plurality of pixels receiving emission current during any particular time. The method and display of the invention has numerous advantages, including a constant emission current over the lifetime of the display, resulting in the benefit of constant brightness of the display image. Another advantage is that the method of the invention can be implemented continuously during operation of the field emission display. Yet another advantage of the invention is an improved operating lifetime, which is greater than the lifetime of an equivalent display operated at a constant gate voltage.

Figure 1:
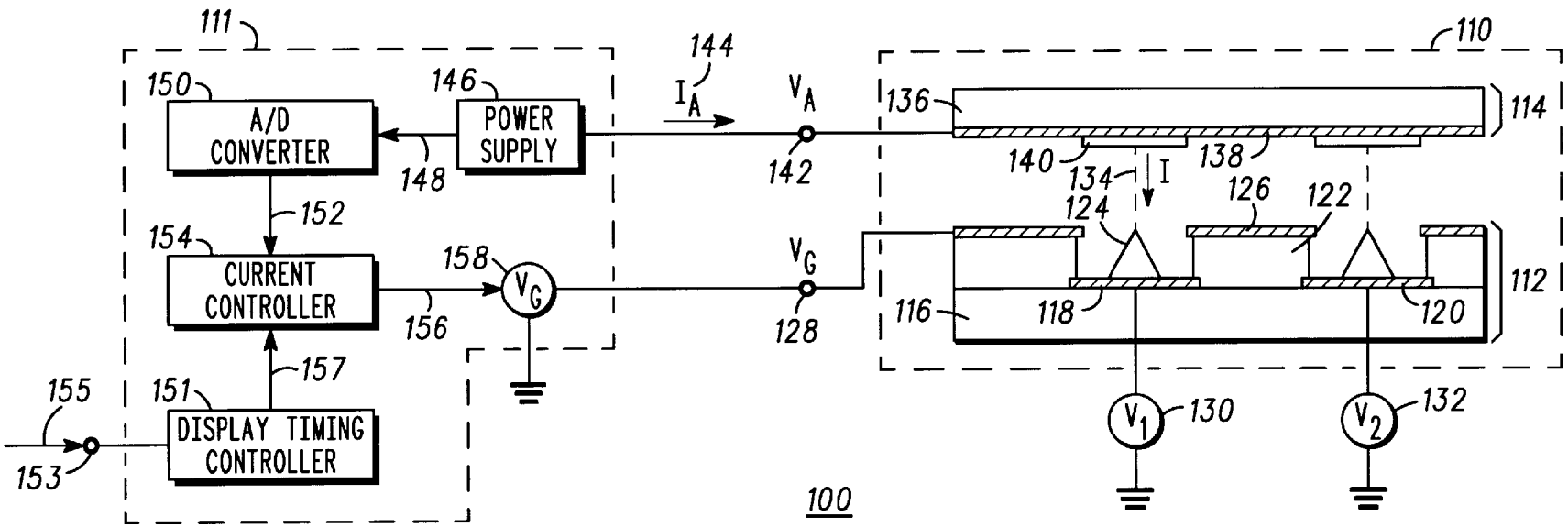
FIG. 1 is a schematic representation of a field emission display, in accordance with an embodiment of the invention.

FIG. 1 is a schematic representation of a field emission display (FED) 100 in accordance with an embodiment of the invention. FED 100 includes a field emission device 110 and a control circuit 111 for controlling emission current.

FED device 110 includes a cathode plate 112 and an anode plate 114. Cathode plate 112 includes a substrate 116, which can be made from glass, silicon, and the like. A first column electrode 118 and a second column electrode 120 are disposed upon substrate 116. First column electrode 118 is connected to a first voltage source 130, V1, and second column electrode 120 is connected to a second voltage source 132, V2. A dielectric layer 122 is disposed upon column electrodes 118, 120, and further defines a plurality of wells.

An electron emitter structure 124, such as a Spindt tip, is disposed in each of the wells. Anode plate 114 is disposed to receive an emission current 134, which is defined by the electrons emitted by electron emitter structures 124. A gate extraction electrode 126 is formed on dielectric layer 122 and is spaced apart from and is proximate to electron emitter structures 124. Column electrodes 118, 120 and gate extraction electrode 126 are used to selectively address electron emitter structures 124.

To facilitate understanding, FIG. 1 depicts only a couple of column electrodes and one gate extraction electrode. However, it is desired to be understood that any number of column and gate extraction electrodes can be employed. An exemplary number of gate extraction electrodes for an FED device is 240, and an exemplary number of column electrodes is 960. Methods for fabricating cathode plates for matrix-addressable field emission displays are known to one of ordinary skill in the art.

Anode plate 114 includes a transparent substrate 136 made from, for example, glass. An anode 138 is disposed on transparent substrate 136. Anode 138 is preferably made from a transparent conductive material, such as indium tin oxide. In the preferred embodiment, anode 138 is a continuous layer that opposes the entire emissive area of cathode plate 112. That is, anode 138 preferably opposes the entirety of electron emitter structures 124.

An input 142 of anode 138 is designed to be connected to a first output of a power supply 146. Power supply 146 includes one of several types of power supplies, such as a stepping-up transformer, a piezo electric power supply, and the like. In the preferred embodiment, power supply 146 is a variable, high-voltage power supply, which can provide an anode voltage, VA, on the order of 5000 volts. An anode current 144, IA, flows from power supply 146 to anode 138. For the values of the anode voltage described herein, a useful assumption is that the magnitude of anode current 144 is equal to the magnitude of emission current 134.

A plurality of phosphors 140 is disposed upon anode 138. Phosphors 140 are cathodoluminescent. Thus, phosphors 140 emit light upon activation by emission current 134. A pixel includes a phosphor 140 and at least one of electron emitter structure 124 that addresses that phosphor. A pixel can include, for example, a blue phosphor, green phosphor, red phosphor, any individual phosphor or combination thereof, and the like. A pixel can also include a monochrome phosphor. Methods for fabricating anode plates for matrix-addressable field emission displays are known to one of ordinary skill in the art.

In accordance with the invention, control circuit 111 includes an analog-to-digital (A/D) converter 150. An input of A/D converter 150 is connected to a second output of power supply 146. An output signal 148 flows from power supply 146 to A/D converter 150. Output signal 148 contains information corresponding to the operating parameters of power supply 146. For example, output signal 148 can contain information about the electrical current, power output, or duty cycle of power supply 146.

In accordance with the method of the invention, emission current 134 or anode current 144 is measured directly, as by making a current measurement, or indirectly. Indirect detection entails extraction of information about emission current 134 from the measured operating parameter of power supply 146. For example, the power output of power supply 146, to a useful approximation, is proportional to anode current 144 and, correspondingly, emission current 134.

A/D converter 150 is responsive to output signal 148 and generates an output signal 152, which is useful for activating a current controller 154. Output signal 152 also contains information corresponding to an operating parameter of power supply 146.

In accordance with the invention, control circuit includes a display timing controller 151. An input 153 of the display timing controller 151 is coupled to receive a video signal 155. Video signal 155 can contain monochrome pixel data, red, green and blue pixel data, and the like. Video signal pixel data indicates which of plurality of pixels are to receive emission current at any given time and the intensity of light to be generated by each of the pixels. Display timing controller 151 has an output connected to a first input of current controller 154. An output signal 157 flows from display timing controller 151 to current controller 154. Output signal 157 contains pixel data indicating which pixels are to be illuminated at any given time. For example, output signal can contain information about which monochrome pixels are to be illuminated, which color pixels (i.e. blue, green, red) pixels are to be illuminated, and the like.

Current controller 154 has an output connected to an input of a gate voltage source 158. An output of gate voltage source 158 is connected to an input 128 of gate extraction electrode 126. Current controller 154 also has a second input connected to an output of A/D converter 150. In response to output signal 152 of A/D converter 150 and an output signal 157 of display timing controller 151, current controller 154 generates an output signal 156. Output signal 156 manipulates gate voltage source 158 to adjust a gate voltage, VG, at gate extraction electrode 126. The gate voltage is adjusted by an amount sufficient to cause emission current 134 and, correspondingly, anode current 144 to reach a set point, desired value.

Figure 2:
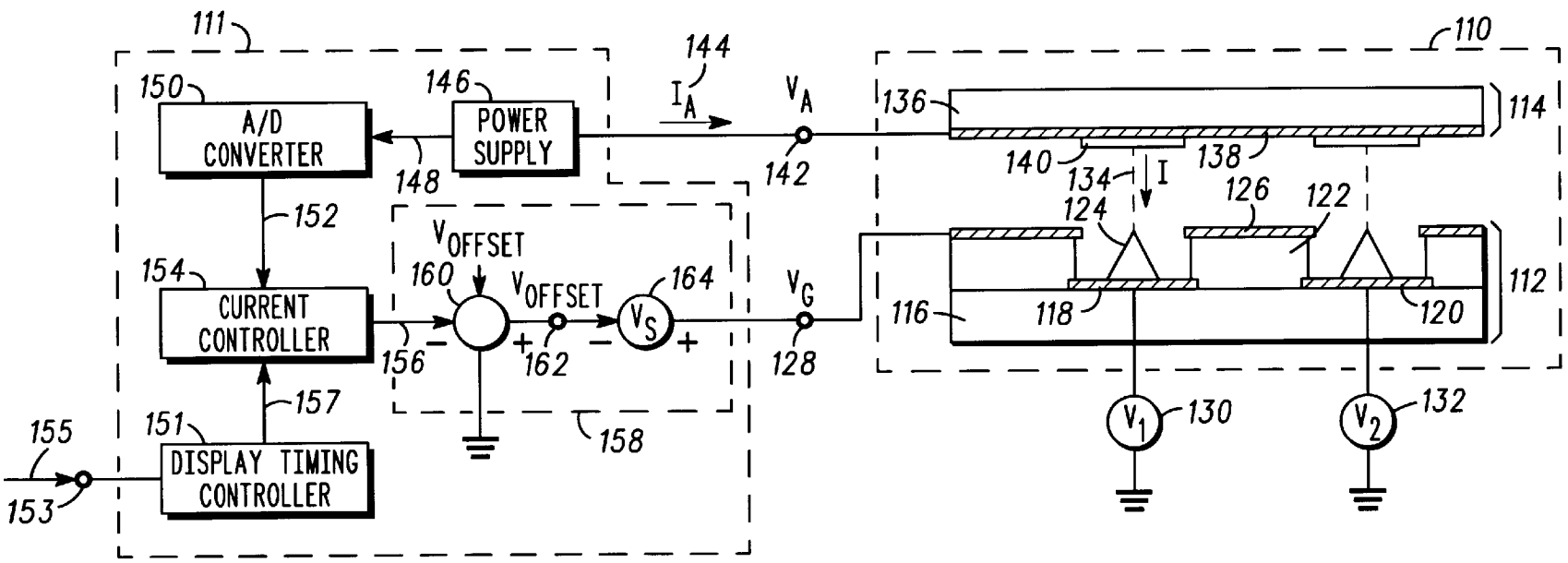
FIG. 2 is a schematic representation of a field emission display having a current controller that manipulates an offset voltage source, in accordance with an embodiment of the invention.

FIG. 2 is a schematic representation of FED 100 having current controller 154 that manipulates an offset voltage source 160, in accordance with an embodiment of the invention. In the embodiment of FIG. 2, gate voltage source 158 includes offset voltage source 160 and a scanning voltage source 164. Offset voltage source 160 has an input coupled for receiving output signal 156 of current controller 154. To adjust the gate voltage in accordance with the invention, output signal 156 manipulates offset voltage source 160.

Offset voltage source 160 provides an offset voltage, VOFFSET, at an output 162. Scanning voltage source 164 is useful for adding a scanning voltage, VS, to the offset voltage. Offset voltage source 160 and scanning voltage source 164 are operably connected to achieve the addition of the offset and scanning voltages. In the embodiment of FIG. 2, offset voltage source 160 is connected in series with scanning voltage source 164, such that output 162 of offset voltage source 160 is connected to a negative input of scanning voltage source 164. Scanning voltage source 164 is activated to provide the scanning voltage by control circuitry (not shown).

Figure 3:
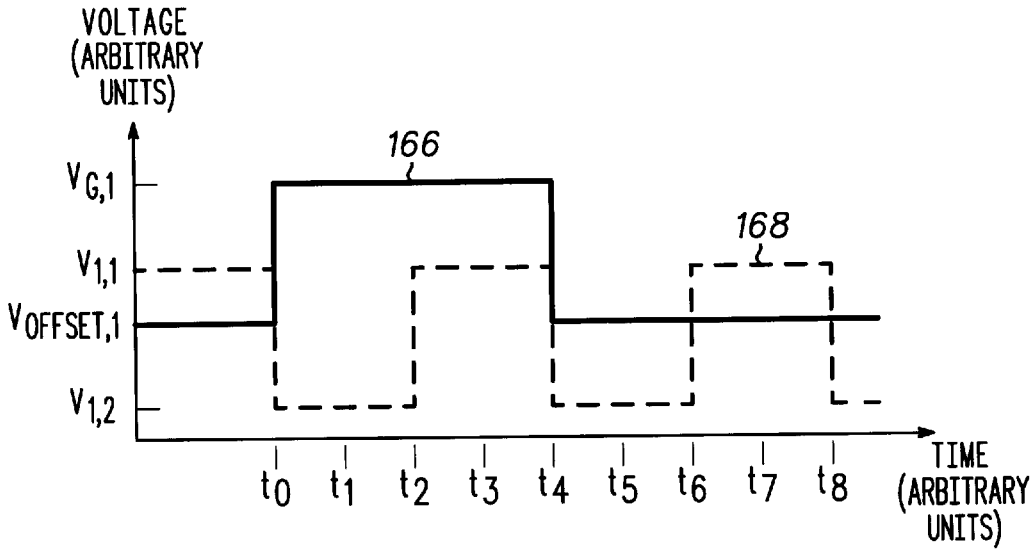
FIG. 3 is a timing diagram illustrating a method for operating a field emission display, in accordance with the invention.

FIG. 3 is a timing diagram illustrating a method for operating FED 100 during the display mode of operation of FED 100. The display mode of operation is characterized by the creation of a display image at anode plate 114. Represented in FIG. 3 is the selective addressing of electron emitter structure 124 at the intersection of gate extraction electrode 126 and first column electrode 118. FIG. 3 illustrates a graph 166 of gate voltage and a graph 168 of column voltage, V1, at first column electrode 118. Before t0, the column voltage is equal to V1,1 and the gate voltage is equal to VOFFSET,1. Because the gate voltage is less than the column voltage, no electron emission occurs. At t0, scanning voltage source 164 is activated, such that a scanning voltage is added to VOFFSET,1, resulting in a gate voltage of VG,1.

Between times t0 and t4, gate extraction electrode 126 is being scanned. That is, electron emitter structures 124 that are located along gate extraction electrode 126 can be caused to emit if an appropriate potential is applied to the corresponding column electrodes. In the example of FIG. 3, electron emitter structure 124 at first column electrode 118 is caused to emit between times t0 and t2 by applying a column voltage of V1,2. That is, the potential difference, ΔV, between the column voltage and the gate voltage is sufficiently large to cause electron emission of a desired value.

At time t2, the column voltage is returned to V1,1, resulting in a ΔV that is insufficient to cause emission, and electron emission ceases. At time t4, the scanning of gate extraction electrode 126 is terminated by deactivating scanning voltage source 164, so that the gate voltage returns to the offset value.

Between times t4 and t8, a different gate extraction electrode is scanned. Between times t4 and t6, first column electrode 118 is once again activated to cause emission at the scanned gate extraction electrode. During the display mode of operation, the anode voltage, VA, is selected to provide a desired brightness level for the light output from anode plate 114. For example, an operating anode voltage, VA,OP, on the order of thousands of volts can be employed. In a preferred embodiment, the operating anode voltage VA,OP is on the order of 5000 volts. However, the invention is not limited by operating anode voltages of this magnitude. Any anode voltage that provides a desired brightness level is within the scope of the invention.

Figure 4:
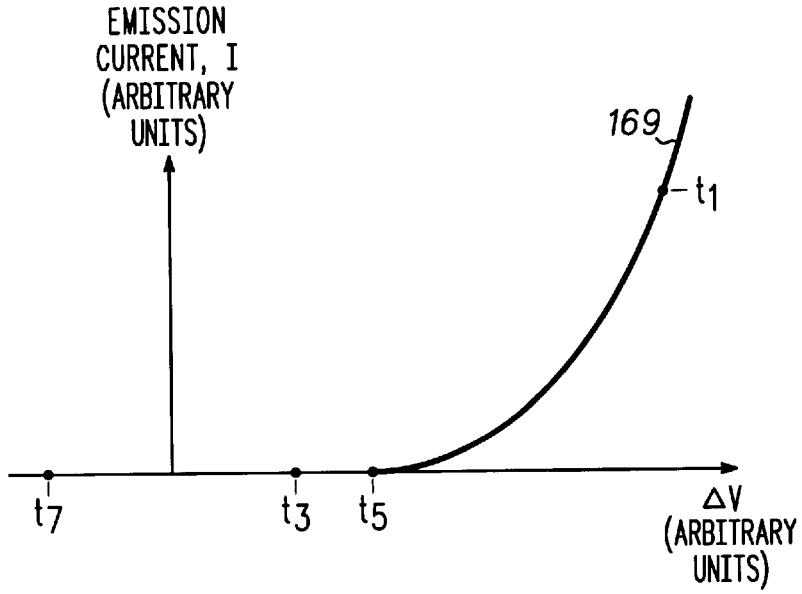
FIG. 4 is a graph of emission current versus potential difference (between column voltage and gate voltage) and further indicates operating points corresponding to various times represented in FIG. 3.

FIG. 4 illustrates a graph 169 of emission current versus potential difference, ΔV, between the column voltage and the gate voltage, and further indicates operating points corresponding to various times represented in FIG. 3. At time t1, emission current 134 is activated, whereas at times t3, t5, and t7, electron emission is negligible.

Figure 5:
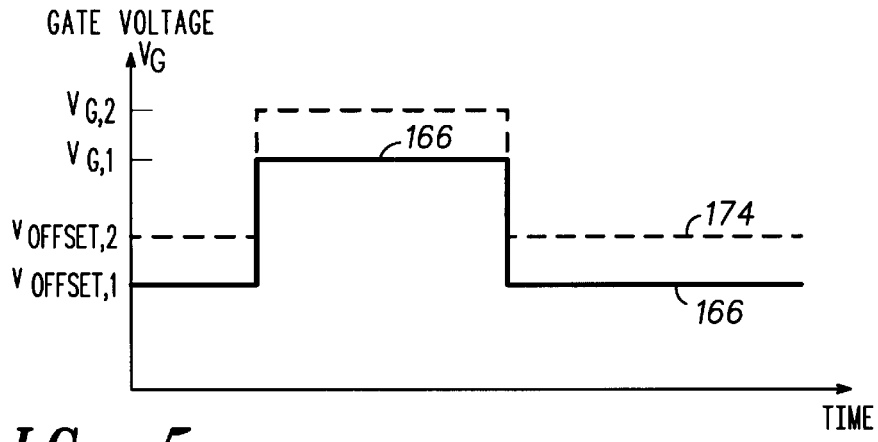
FIG. 5 is a graph of gate voltage before and after a step of adjusting a gate voltage to control the emission or anode current, in accordance with the invention.

FIG. 5 illustrates graph 166 of FIG. 3 and a graph 174 of the gate voltage before and after, respectively, a step of adjusting the gate voltage to control the emission or anode current in accordance with the invention. During the operation of FED 100, the offset voltage is initially set at VOFFSET,1. When gate extraction electrode 126 is scanned, the scanning voltage is added, resulting in a gate voltage of VG,1.

At a subsequent time in the operation of FED 100, the gate voltage is adjusted in accordance with the invention. If emission current 134 has decreased, the adjusted gate voltage, as indicated by graph 174, is greater than the initial gate voltage 166. During the adjustment, the offset voltage is increased to VOFFSET,2. Subsequently, when gate extraction electrode 126 is scanned, the constant scanning voltage is added to the adjusted offset voltage, increasing the gate voltage to VG,2.

The scope of the invention is not limited to manipulation of the offset voltage for achieving adjustment of the gate voltage. For example, the scanning voltage can be manipulated.

Figure 6:
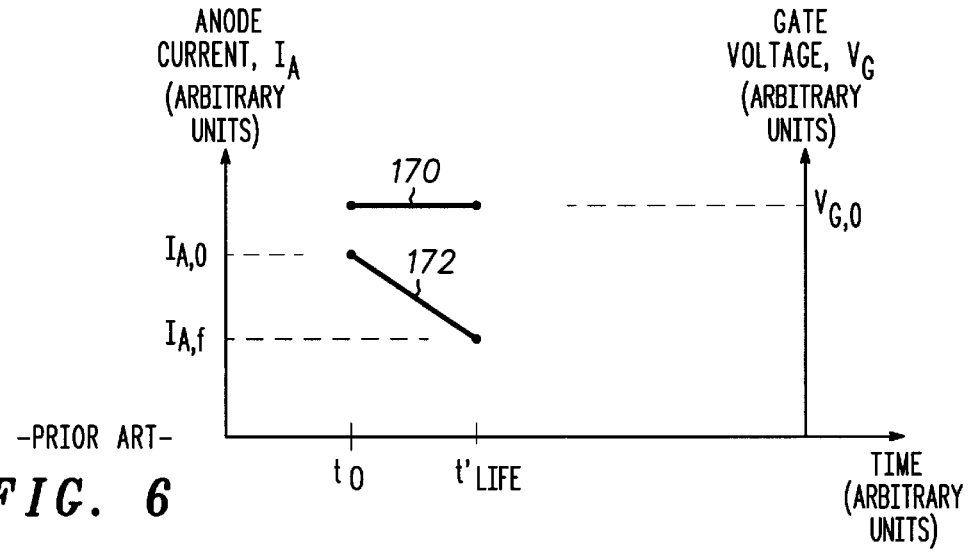
FIG. 6 illustrates graphs of anode current and gate voltage for a prior art method of operating a field emission display.

FIG. 6 illustrates a graph 170 of gate voltage and a graph 172 of anode current for a prior art method of operating a field emission display. As illustrated by graph 170, the gate voltage remains constant at VG,0 over the operating lifetime of the display. Furthermore, the anode current, which corresponds to the emission current, is not controlled, so that it decreases continuously during the operating lifetime of the display, as indicated by graph 172. Operation of the prior art FED starts at time t0. The prior art display lifetime, t'LIFE, is defined as the total operating time required for the anode current to reach a selected value, IA,f. The value of IA,f is typically expressed as a percentage of an initial anode current, IA,0, such as 50% of IA,0.

Figure 7:
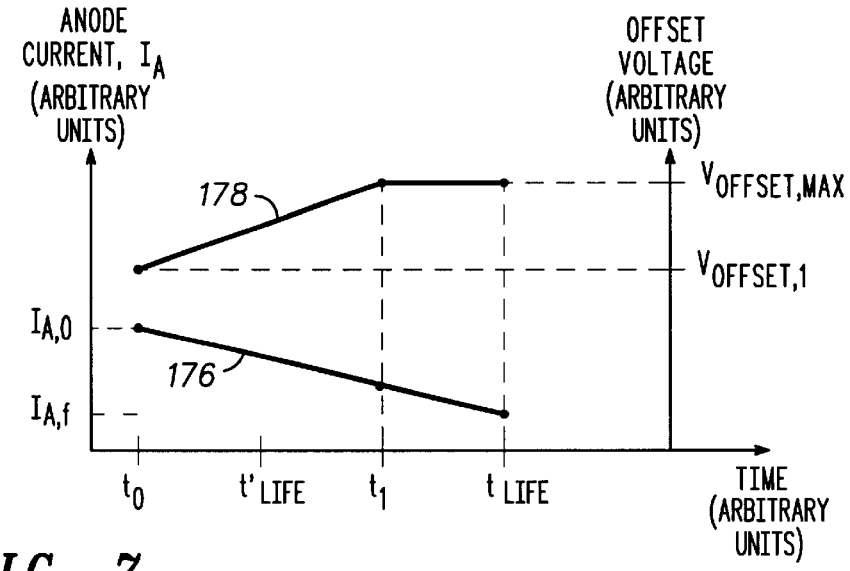
FIG. 7 illustrates graphs of anode current and offset voltage, in accordance with the method of the invention.

FIG. 7 illustrates a graph 176 of anode current 144 and a graph 178 of offset voltage, in accordance with the method of the invention. The abscissa represents operating time, during which FED 100 is in a display mode of operation. The times specifically indicated on the abscissa in FIG. 7 do not necessarily correspond to times specifically indicated in the other figures of the description.

In the example of FIG. 7, the control method of the invention is performed continuously during the operation of FED 100. For the purpose of distinguishing or contrasting the display operating lifetime from that of the prior art, the initial value, IA,0, and final value, IA,f, of anode current 144 in FIG. 7 are selected to be equal to those of FIG. 6.

Operation of FED 100 begins at time t0. As the anode current 144 decreases during operation of FED 100, the offset voltage is adjusted in accordance with the method of the invention. In accordance with the method of the invention, the offset voltage is adjusted continuously during operation of FED 100. In the embodiment shown in FIG. 7, offset voltage is increased during operation of FED 100, which decreases the rate of decrease of the anode current 144. This has the effect of extending the display lifetime from the prior art display lifetime, t'LIFE, to an operating lifetime, tLIFE. The operating lifetime, tLIFE achieved by the method of the invention is longer than the prior art display lifetime, t'LIFE.

The operating lifetime, tLIFE, of FED 100 is determined by a maximum offset voltage, VOFFSET,MAX, and by the lower limit, IA,f, of anode current 144. The maximum offset voltage can be defined by the operating limits of offset voltage source 160. The maximum offset voltage can equal a maximum voltage provided by offset voltage source 160. Alternatively, the maximum offset voltage may be defined by limits placed upon switching power requirements or by driver limitations.

Thus, for the embodiment represented by FIG. 7, the operating lifetime includes the time, t1, required to reach the maximum offset voltage, VOFFSET,MAX. The operating lifetime further includes the operating time (tLIFE−t1) required for anode current 144 to reach the selected, final value, IA,f, while FED 100 operates at a constant offset voltage of VOFFSET,MAX.

The slopes of graphs 176 and 178 are depicted in FIG. 7 as being linear. However, the slopes can be non-linear. Furthermore, the duration of each operating period, (t1−t0) and (tLIFE−t1) can vary and are not necessarily equal to the relative magnitudes depicted in FIG. 7.

Indicated in FIG. 7 is the lifetime, t'LIFE, of the prior art represented in FIG. 6. As is evident from FIG. 7, the method of the invention provides an appreciably improved display operating lifetime, tLIFE, over that of the prior art. However, the realized improvement in lifetime may not be equal to that shown in FIG. 7.

As described with reference to FIG. 7, adjustment of the gate voltage in accordance with the invention can occur continually during operation of the display. The scope of the invention is not limited to this particular timing scheme. For example, the steps of the invention can be performed intermittently, for example, at the end of selected display frames, during blanking intervals, and the like.

Figure 8:
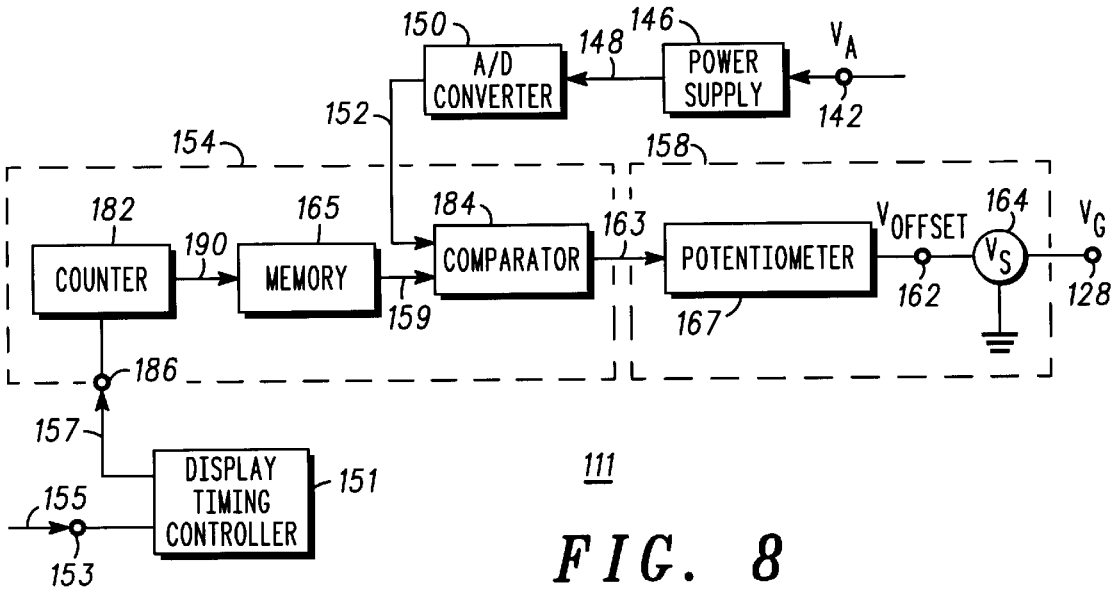
FIG. 8 is a block diagram of a control circuit for controlling emission current, in accordance with the preferred embodiment of the invention.

FIG. 8 is a block diagram of control circuit 111, for controlling emission current in accordance with the preferred embodiment of the invention. In the embodiment of FIG. 8, current controller 154 includes a counter 182, a memory 165 and a comparator 184. Gate voltage source 158 further includes a potentiometer 167.

An input 186 of counter 182 is connected to the output of display timing controller 151. The output of counter 182 is connected to an input of memory 165. The output of memory 165 is connected to first input of comparator 184. Output signal 152 of A/D converter 150 is connected to a second input of comparator 184. An output of comparator 184 is connected to input of potentiometer 167.

Output signal 152 of A/D converter 150 is a digital signal, which is transmitted to second input of comparator 184. The width and frequency of the pulses encode information corresponding to the operating parameters of power supply 146. That is, output signal 152 is a function of, for example, time, temperature, output power, and/or duty cycle.

Output signal 157 of display timing controller 151 transmits pixel data, which contains data on the number of pixels illuminated at any given time, to input 186 of counter 182. Counter 182 counts the number of pixels illuminated at any given time and transmits such data via counter output signal 190 to input of memory 165. Memory 165 uses counter output signal 190 to define a set point value. The set point value is transmitted via memory output signal 159 to first input of comparator 184. Memory 165 contains data on the total number of pixels on a given anode 138 and can therefore define a portion of plurality of pixels receiving emission current at any given time as a percentage of the plurality of pixels on the anode 138 (i.e. percent screen illumination) based on output signal 157 from display timing controller 151.

Comparator 184 utilizes the information provided by output signal 152 of A/D converter 150 and memory output signal 159 to determine the required adjustment of the offset voltage. In the embodiment of FIG. 8, the offset voltage is determined by an output signal 192 of potentiometer. Thus, comparator 184 performs the function of enabling the potentiometer to adjust the output 162 of offset voltage source 160.

For example, the step of adjusting the gate voltage can be achieved by measuring a value of emission current 134 to define a measured value, measuring the plurality of pixels receiving emission current 134 as a percentage of the plurality of pixels on the anode 138 to define a set point value, and comparing the measured value with the set point value. The gate voltage can then be adjusted to cause the emission current to approach the set point value. For the embodiment of FIG. 8, the operation utilizes the detected value of emission current 134 to arrive at a configuration for potentiometer 167 to adjust the output 162 of offset voltage 160.

Formulation of the set point value requires information about the total number of pixels on the anode 138 and the total number of pixels receiving emission current 114 at any given time. This information is captured from display timing controller 151, which receives a video signal 155 having pixel data for a given frame and transmits this to display driver electronics (not shown). Pixel data contains information about which pixels are to receive emission current 134 during, for example, a given frame, and the like.

A set point value can be defined, for example, by an arithmetic logic unit (ALU) having a programmable computation algorithm which is user defined to correspond to particular characteristics of an FED 100, a look-up-table, a circuit, and the like. In a preferred embodiment, the set point value is defined based on maximum anode current 144, IA. As an example of a preferred embodiment, the set point value is defined by the following:

| % Screen Illumination | Set point Value |
|---|---|
| 10 | 0.1IA |
| 20 | 0.2IA |
| 30 | 0.3IA |
| 40 | 0.4IA |
| 50 | 0.5IA |
| 60 | 0.6IA |
| 70 | 0.7IA |
| 80 | 0.8IA |
| 90 | 0.9IA |
| 100 | 1.0IA |

where IA is the maximum anode current 144.

Memory output signal 159 transmits set point value to first input of comparator 184. Set point value is then compared with measured value of emission current 134. If the measured value of emission current 134 is not equal to the set point value, comparator 184 activates potentiometer 167, which adjusts the gate voltage in a manner sufficient to cause emission current 134 to approach the set point value. Most preferably, emission current 134 is caused to equal the set point value. Potentiometer 167 is coupled for receiving an output signal 163 of comparator 184, which allows potentiometer 167 to adjust gate voltage to cause emission current 134 to approach the set point value. In the present embodiment, potentiometer 167 adjusts gate voltage by increasing or decreasing offset voltage 160 in order to cause emission current 134 to approach the set point value.

In a preferred embodiment of the invention, adjustment of gate voltage and emission current 134 occur constantly during operation of the FED 100. However, the invention is not limited to constant adjustment of these parameters. The sample time of emission current 134 and percent screen illumination, adjustment periodicity and maximum emission current are all user definable. In other words, the method of the invention can perform adjustments to gate voltage and emission current at specified times as opposed to constantly during operation of FED 100.

It is desired to be understood that the scope of the invention is not limited by the use of maximum emission current as a basis for deriving set point value. Other variables can also be used, for example, gate voltage, offset voltage, screen brightness, and the like. Also, the scope of the invention is not limited by the use of a look-up-table, ALU, etc. The invention could also be implemented using hard-wired electrical circuitry, and the like.

The method of the invention has the advantage of providing a constant emission current 134, and corresponding constant display image brightness over the lifetime of the FED 100. Another advantage is that the method of the invention can occur constantly during operation of FED 100. Yet another advantage is that the method of the invention provides real-time data on the condition of FED 100 (i.e. the present value of anode current 144 relative to final value, IA,f of anode current 144). Still yet another advantage of the invention is an extended display lifetime over that of prior art, constant gate voltage displays.

Figure 9:
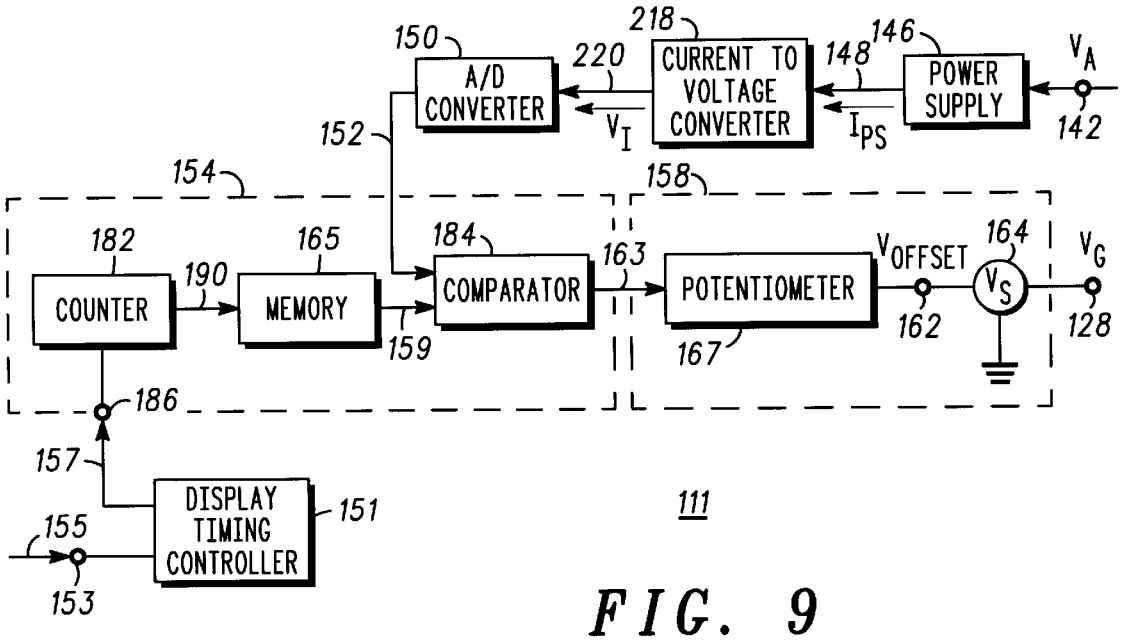
FIG. 9 is a block diagram of a control circuit for controlling emission current, in accordance with another embodiment of the invention It will be appreciated that for simplicity and clarity of illustration, elements shown in the drawing have not necessarily been drawn to scale. For example, the dimensions of some of the elements are exaggerated relative to each other. Further, where considered appropriate, reference numerals have been repeated among the Figures to indicate corresponding elements.

FIG. 9 is a circuit diagram of control circuit 111 for controlling emission current 134, in accordance with another embodiment of the invention. In the embodiment of FIG. 9, emission current 134 is measured by measuring a current, IPS, passing through power supply 146. For example, the measured current can be a current passing through a secondary coil of a stepping-up transformer of power supply 146. In the embodiment of FIG. 9, output signal 148 from power supply 146 is a current signal.

In the embodiment of FIG. 9, a current-to-voltage converter 218 is coupled to receive output signal 148. An input of current-to-voltage converter 218 is designed to be connected to power supply 146, and an output of current-to-voltage converter 218 is connected to a first input of A/D converter 150. The circuitry of current controller 154 and gate voltage source 158 is described with reference to FIG. 8.

Output signal 148 from power supply 146 is transmitted to current-to-voltage converter 218, which includes circuitry useful for converting the current signal of output signal 148 to a corresponding voltage signal 220. For example, current-to-voltage converter 218 can be a simple resistor.

Comparator 184 and gate voltage source 158 function in a manner similar to that described with reference to FIG. 8, resulting in the adjustment of the gate voltage as described with reference to FIG. 8.

In summary, the invention is for a method and a field emission display useful for maintaining a constant emission current over the lifetime of the display. The method of the invention includes a step for measuring an emission current and comparing it to a set point value. If the measured value and the set point value are not equal, a gate voltage is manipulated to cause emission current to approach the set point value. The set point value is determined based on the percentage of the plurality of pixels receiving emission current during any particular time. The method of the invention has numerous advantages including maintaining a constant emission current over the lifetime of the display, and the corresponding advantage of maintaining constant image brightness over the lifetime of the display. Another advantage is that the method of the invention allows adjustment for constant emission current to occur constantly during operation of the display. Yet another advantage is that real-time data on the condition of the display is made available. Still yet another advantage of the invention is an extended display lifetime over prior art displays.

While we have shown and described specific embodiments of the present invention, further modifications and improvements will occur to those skilled in the art. For example, the emission current can be measured by measuring the anode current at the input to the anode.

We desire it to be understood, therefore, that this invention is not limited to the particular forms shown and we intend in the appended claims to cover all modifications that do not depart from the spirit and scope of this invention.

What is claimed is:

1. A method for controlling an emission current in a field emission display comprising the steps of:

providing a plurality of electron emitter structures designed to emit electrons which define the emission current;

providing a gate extraction electrode;

applying a gate voltage to the gate extraction electrode;

providing an anode having a plurality of pixels, wherein the plurality of pixels are designed to receive the emission current, and wherein at least a portion of the plurality of pixels receives the emission current;

measuring the emission current, which defines a measured value;

measuring the portion of the plurality of pixels receiving the emission current as a percentage of the plurality of pixels on the anode to define a set point value;

comparing the measured value with the set point value, and adjusting the gate voltage to cause the emission current to approach the set point value.

2. The method for controlling an emission current in a field emission display as claimed in claim 1, further comprising the step of receiving a video signal having pixel data indicating the portion of the plurality of pixels to receive the emission current.

3. The method for controlling an emission current in a field emission display as claimed in claim 1, wherein the step of adjusting the gate voltage is performed continuously during operation of the field emission display.

4. The method for controlling an emission current in a field emission display as claimed in claim 1, wherein the step of measuring the emission current comprises the steps of receiving the emission current at the anode which defines an anode current, and measuring the anode current.

5. The method for controlling an emission current in a field emission display as claimed in claim 1, further comprising the step of coupling the anode to a power supply, and wherein the step of measuring the emission current comprises the steps of receiving the emission current at the anode and measuring a power output of the power supply.

6. The method for controlling an emission current in a field emission display as claimed in claim 1, further comprising the step of coupling the anode to a power supply, and wherein the step of measuring the emission current comprises the steps of receiving the emission current at the anode and measuring a current passing through the power supply.

7. The method for controlling an emission current in a field emission display as claimed in claim 1, wherein the step of adjusting the gate voltage comprises the step of adjusting the gate voltage in a manner sufficient to cause the emission current to equal the set point value.

8. The method for controlling an emission current in a field emission display as claimed in claim 1, wherein the step of applying a gate voltage comprises the step of applying an offset voltage to the gate extraction electrode, and wherein the step of adjusting the gate voltage comprises the step of adjusting the offset voltage in a manner sufficient to cause the emission current to approach the set point value.

9. The method for controlling an emission current in a field emission display as claimed in claim 1, wherein the step of measuring the portion of the plurality of pixels receiving the emission current comprises the step of defining the set point based on a maximum anode current.

10. A field emission display comprising:

a plurality of electron emitter structures designed to emit electrons which define an emission current;

a gate extraction electrode spaced apart from the plurality of electron emitters;

an anode having a plurality of pixels, wherein the plurality of pixels are disposed to receive emission current, and wherein at least a portion of the plurality of pixels receives the emission current; and a control circuit coupled to the anode and the gate extraction electrode, wherein the control circuit is coupled for receiving a video signal having pixel data which defines the portion of the plurality of pixels to receive emission current, and wherein the control circuit adjusts the emission current based on the portion of the plurality of pixels to receive emission current.

11. The field emission display as claimed in claim 10, wherein the emission current is adjusted continuously during operation of the field emission display.

12. The field emission display as claimed in claim 10, wherein the emission current is adjusted based on a portion of the plurality of pixels receiving the emission current as a percentage of the plurality of pixels on the anode.

13. The field emission display as claimed in claim 10, wherein the control circuit comprises:

a power supply having a first and second output, wherein the first output is coupled to the anode;

an analog-to-digital converter having an input and an output, wherein the input is coupled to the second output of the power supply;

a current controller having a first input, a second input and an output, wherein the second input is coupled to the output of the analog-to-digital converter;

a display timing controller having an input and an output, wherein the input is coupled for receiving the video signal having pixel data, and wherein the output is coupled to the first input of the current controller; and a gate voltage source having an input and an output, wherein the input is coupled to the output of the current controller and the output is coupled to the gate extraction electrode.

14. The field emission display as claimed in claim 13, wherein the gate voltage source comprises an offset voltage source and a scanning voltage source, wherein the offset voltage source is operably coupled to the scanning voltage source, such that the scanning voltage source, when activated, adds a scanning voltage to an offset voltage provided by the offset voltage source.

* * * * *